United States Patent [19]

Voccio et al.

[11] 4,257,241

[45] Mar. 24, 1981

[54] EARRING CONSTRUCTION

[76] Inventors: Joseph B. Voccio, 10 Fern Dr., Rumford, R.I. 02916; Paul A. Voccio, 303 Newman Ave., Seekonk, Mass. 02771

[21] Appl. No.: 78,392

[22] Filed: Sep. 24, 1979

[51] Int. Cl.[3] ..... A63H 7/00

[52] U.S. Cl. ..... 63/14 D; 24/255 R; 63/14 G

[58] Field of Search ..... 63/14 D, 14 F, 14 G, 63/2; 24/139, 255 R, 255 BS

[56] References Cited

U.S. PATENT DOCUMENTS

| | | | |
|---|---|---|---|
| 1,662,175 | 3/1928 | Thorne | 24/255 R |
| 2,526,766 | 10/1950 | Ornell | 24/255 R X |
| 2,710,511 | 6/1955 | Baldwin | 63/14 F |
| 3,350,754 | 11/1967 | Ballenger et al. | 24/255 R |

FOREIGN PATENT DOCUMENTS

| | | | |
|---|---|---|---|
| 925311 | 5/1973 | Canada | 63/14 G |
| 1133658 | 11/1956 | France | 63/14 G |
| 1166771 | 6/1958 | France | 63/2 |
| 2333462 | 7/1977 | France | 63/11 |
| 899819 | 6/1962 | United Kingdom | 63/14 G |

*Primary Examiner*—F. Barry Shay
*Attorney, Agent, or Firm*—Robert J. Doherty

[57] ABSTRACT

An earring having a body including an outer ornamental face and spring means for resiliently clamping the body on the lobe of the wearer's ear. The spring is longitudinally oriented in generally parallel disposition to a elongated earring similarly configured body and is disposed in opposition to the inner surface of the body so as to in cooperation therewith form a pocket for the receipt of the wearer's ear lobe. The spring generally bridges opposed ends of the body and terminates at one end in an enlarged head to form a narrowed entrance to the pocket. The spring is preferably of helical construction in exhibiting a plurality of individual coils which enables the enlarged head portion thereof to assume a plurality of positions with respect to the inner surface of the body.

7 Claims, 6 Drawing Figures

EARRING CONSTRUCTION

BACKGROUND AND SUMMARY OF THE INVENTION

This invention relates to an earring construction and particularly to those type earrings which are resiliently spring clamped to the wearer's ear lobe. The desirable features of such earring constructions are that they firmly secure the earring to the ear lobe against accidental loss and yet while accommodating such locking feature do not utilize such force as to render the earring uncomfortable to wear. Further desirable features include their ease in attachment and removal to the earlobe as well as permitting a variety of positions of the clamping member relative to the decorative portion of the earring so as to facilitate various size ear lobes as well as various mounting positions thereon.

Various prior art earring constructions are known which may be characterized as attempting to fulfill one or more of such desirable attributes. For example, U.S. Pat. No. 2,710,511 issued June 14, 1955 discloses an earring with a ball and coil spring mounted on the free end of a U-shaped wire-like spring clamp in turn attached to the back surface of the ornamental body portion of an earring. The coil spring serves to resiliently urge a ball member 15 against one surface of the ear lobe to facilitate a pinching action and accordingly mount the earring to the ear lobe in such a manner. Another earring construction is shown in U.S. Pat. No. 3,459,007 issued Aug. 5, 1969 which concerns an earring structure having a leaf-spring type element of a fixed shape so as to conform to the natural cross-sectional shape of an ear lobe affixed thereto such that the earring can be slipped on and off of the wearer's ear lobe. The above constitutes applicants' Prior Art Statement. Such constructions do not, however, fulfill all of the previously indicated desirable attributes and accordingly there remains a need for an earring construction of improved performance.

Accordingly, a primary object of the present invention is the provision of a improved earring construction which lightly but adequately resiliently clamps an ornamental body portion to the ear lobe of the wearer in such a manner that it is both easily attached and removed therefrom.

A further object of the present invention is the provision of an improved earring construction of the aforementioned type which is relatively low in cost and simple in use and yet which accomplishes all of the aforementioned objectives.

A still further object of the present invention is the provision of an improved earring construction as set forth in the aforementioned objects which additionally facilitates the accommodation of a wider degree of ear lobe sizes.

These and other objects of the present invention are accomplished by an earring having a body including an outer ornamental face and means for resiliently clamping said body on the lobe of the wearer's ear. The body has first and second longitudinally spaced ends in an intermediate main body portion wherein at least said first end is inwardly offset from said main body portion to define a somewhat concave inner body surface. The clamping means includes a generally straight, longitudinally directed spring fixedly attached at one end thereof to said body first end and extending over said concave inner body surface to define a lobe receiving pocket by generally bridging said body ends, said spring other end positioned adjacent said second body end to define a narrowed entrance to said pocket, said spring adapted to be flexed away from said body inner surface to accommodate various sized ear lobes while continuously resiliently being urged to its normal bridging position.

Other objects, features and advantages of the invention shall become apparent as the description thereof proceeds when considered in connection with the accompany illustrative drawing.

DESCRIPTION OF THE DRAWING

In the drawing which illustrates the best mode presently contemplated for carrying out the present invention.

DESCRIPTION OF THE INVENTION

Figure 1:
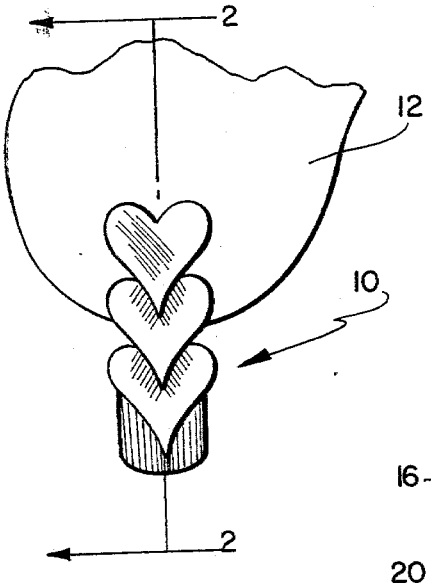
FIG. 1 is a partial side view of a weaver's ear lobe with the earring construction of the present invention positioned thereon.

Turning now to the drawing and particularly FIG. 1 thereof, the earring construction 10 of the present invention is shown mounted upon the wearer's ear lobe 12 in the intended manner. The earring 10 includes a body 14 having an outer decorative surface 16 and an inner surface 18 opposed thereto. Body 14 is longitudinally oriented and furthermore includes a main or central body portion 20 which terminates at the lower end thereof in an inwardly extending ledge 22 in turn provided with a longitudinally extending bore 24 of circular cross-sectional configuration and open at the top end thereof, that is, that end adjacent the intermediate body section 20. The other end of the body also preferably terminates in an inwardly extending end 26. The inner surfaces of the body portion 20 as well as the ends 22 and 26 thus cooperatively form a pocket 28 of generally concave configuration adapted to accommodate the wearer's ear lobe as best shown in FIG. 2.

The earring 10 is further provided with clamping means for affixing the body 14 to the ear lobe in the intended manner. Such clamping means includes a coil spring 30 having its lower terminal end disposed with the bore 24 for fixedly positioning the spring 30 with respect to the body 14. In that regard, the lower end of the spring 30 may be soldered, brazed or otherwise adhesively connected to the ledge 22 or may be frictionally held by contact between the outer surface of several of the individual coils forming the spring 30 and the inner surface of the bore 24. The other end of the spring 30 preferably terminates in an enlarged head 32 which may be of spherical shape and provided with a bore 34 extending upwardly thereinto for receipt of the other end of the spring 30 much in the same manner as the opposite end of the spring is received within the bore 24. The head 34 is adjacent to the body end 26 and may contact such, that is, the spring 30 accordingly extends across the back surface of the body 14 in a manner so as to form a bridge between the ends 22 and 26.

Figure 2:
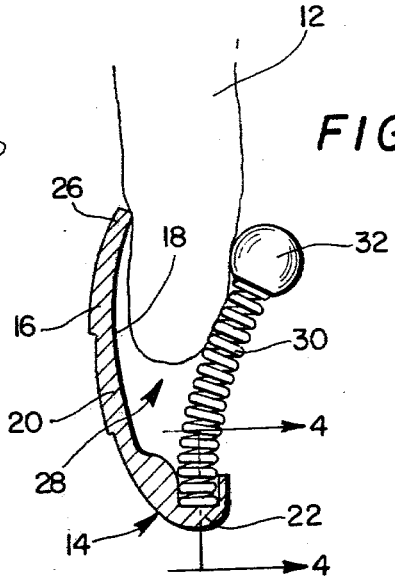
FIG. 2 is an elevational sectional view taken along the line 2—2 of FIG. 1.
Figure 3:
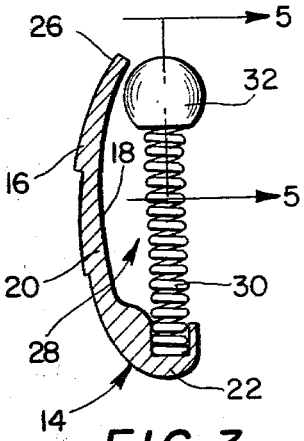
FIG. 3 is an elevational view of the earring construction shown in FIGS. 1 and 2.
Figure 4:
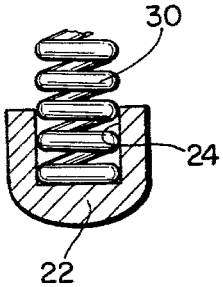
FIG. 4 is a partial sectional view taken along the line 4—4 of FIG. 2.
Figure 5:
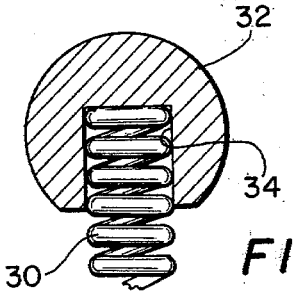
FIG. 5 is a partial sectional view taken along the line 5—5 of FIG. 3.
Figure 6:
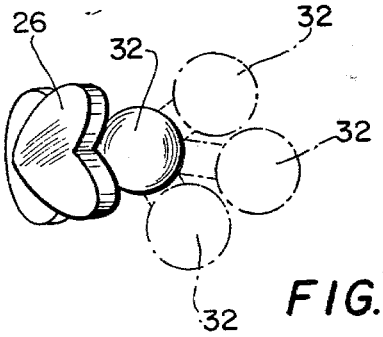
FIG. 6 is a top plan view of the earring construction shown in FIG. 3 with various alternative positions of the enlarged head thereof shown in phantom.

Accordingly, the spring 30 may be outwardly flexed from its position as shown in FIG. 3 to its position shown in FIG. 2 so as to accommodate the ear lobe 12. However, when utilizing a coil spring such as that shown, the head may assume various alternate positions other than in a direction within a plane normal to the inner surface of the body 20. Such alternate position are shown by the various phantom line representations of the head 32 in FIG. 6, it being clear that such movement affords a larger degree of movement to the terminal head 32 of the spring and thus enables the earring 10 to accommodate various size, i.e. thickness ear lobes, as well as being able to be positioned on various portions of the ear lobe 12. Thus, while springs other than the coil spring depicted may be utilized such as a flat spring mounted within a laterally extending slot in the ledge 22, in such cases, a more limited movement to the spring would be dictated, i.e. primarily limited to a inward and outward motion within a plane normal to the lateral extent of the body 14. The use of a coil spring furthermore enables the spring to bend along its longitudinal extent to thus better accommodate the ear lobe yet not diminish the application of a consistent resilient force applied thereagainst to insure retention of the earring 10 on the ear lobe 12.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An earring having a body including an outer ornamental face and means for resiliently clamping said body on the lobe of the wearer's ear with said outer face in view, said body having first and second longitudinally spaced ends and an intermediate main body portion, at least said first end inwardly offset from said main body portion to define a concave inner body surface, said clamping means being a generally straight, longitudinally directed coil spring of a single directional run attached at one end thereof to said body first end and extending over said inner body surface to define a lobe receiving pocket area by generally bridging said body ends said spring other end positioned adjacent said second body end to define a narrowed entrance to said pocket, and spring adapted to be flexed away from said body inner surface in a plurality of directions relative thereto to accommodate various sized ear lobes while continuously resiliently being urged to its normal bridging position, said spring other end terminating in an enlarged head having an arcuate surface disposed in opposition to said second body end.

2. The earring construction of claim 1, said body first end having a longitudinally directed opening therein for receipt of said one spring end therein.

3. The earring construction of claim 1, said enlarged head being a separate generally spherical element having an opening for receipt of said spring other end therein whereby said element and said spring are attached to each other.

4. The earring construction of claim 1, said enlarged head disposed adjacent to but short of said body second end.

5. The earring construction of claim 1, said enlarged head contacting said body second end.

6. An earring having a body including an outer ornamental face and means for resiliently clamping said body on the lobe of the wearer's ear with said outer face in view, said body having first and second longitudinally spaced ends and an intermediate main body portion to define an inner body surface, said clamping means being a generally straight, longitudinally directed spring fixedly attached at one end thereof to said body first end and extending over said inner body surface to define a lobe receiving pocket area by generally bridging said body ends, said spring other end positioned adjacent said second body end to define a narrowed entrance to said pocket, said spring adapted to be flexed away from said body inner surface to accommodate various sized ear lobes while continuously resiliently being urged to its normal bridging position, said spring being a coil spring whereby said spring other end may be resiliently urged in a plurality of directions with respect to said second body end, said body first end having an inwardly extending ledge, said ledge having a longitudinally extending bore of circular section open adjacent said pocket, said one end of said coil spring positioned in said bore.

7. The earring construction of claim 6, individual coils of said spring frictionally contacting the walls of said bore so as to position said spring one end therein.

* * * * *